US010535308B2

(12) United States Patent
Ota

(10) Patent No.: US 10,535,308 B2
(45) Date of Patent: Jan. 14, 2020

(54) ELECTRO-OPTICAL DEVICE AND ELECTRONIC APPARATUS

(71) Applicant: SEIKO EPSON CORPORATION, Tokyo (JP)

(72) Inventor: Hitoshi Ota, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 225 days.

(21) Appl. No.: 15/420,563

(22) Filed: Jan. 31, 2017

(65) Prior Publication Data

US 2017/0236471 A1 Aug. 17, 2017

(30) Foreign Application Priority Data

Feb. 12, 2016 (JP) ..... 2016-024833

(51) Int. Cl.
*G09G 3/3266* (2016.01)
*G09G 3/3258* (2016.01)
*G09G 3/3291* (2016.01)

(52) U.S. Cl.
CPC ..... *G09G 3/3266* (2013.01); *G09G 3/3258* (2013.01); *G09G 3/3291* (2013.01); *G09G 2300/0426* (2013.01); *G09G 2310/0291* (2013.01); *G09G 2310/0297* (2013.01)

(58) Field of Classification Search
CPC .. G09G 3/3266; G09G 3/3258; G09G 3/2092; G09G 3/3291; G09G 3/3275; G09G 3/3233; G09G 2300/0861; G09G 2310/0297; G09G 2310/0291; G09G 2300/0819; G09G 2300/0426; G09G 2300/0842; G09G 2310/08
See application file for complete search history.

(56) References Cited

U.S. PATENT DOCUMENTS

2006/0022908 A1 2/2006 Schwanenberger et al.
2008/0180356 A1 7/2008 Minami et al.
2011/0242072 A1* 10/2011 Ota ..... G09G 3/3233 345/204
2013/0314306 A1 11/2013 Yamashita et al.
(Continued)

FOREIGN PATENT DOCUMENTS

JP 2004-354567 A 12/2004
JP 2006-039572 A 2/2006
JP 2008-191295 A 8/2008
(Continued)

*Primary Examiner* — Aneeta Yodichkas
(74) *Attorney, Agent, or Firm* — Oliff PLC

(57) ABSTRACT

An electro-optical device that includes a display unit includes a scan line drive circuit, supplies a predetermined control signal including at least one scan signal to each row, and includes at least a logic circuit generates a control signal, and an output circuit outputs the control signal to the pixel circuit, a first power supply line supplies a first operation voltage to the pixel circuit, a second power supply line supplies a second operation voltage to the scan line drive circuit and is disposed separately from a portion of the first power supply line which is located within a pixel circuit, and a third power supply line supplies the first operation voltage to the output circuit from the first power supply line and is disposed separately from a portion of the second power supply line which is located within the scan line drive circuit.

3 Claims, 7 Drawing Sheets

(56) References Cited

U.S. PATENT DOCUMENTS

| | | | |
|---|---|---|---|
| 2014/0340288 | A1 | 11/2014 | Yamashita et al. |
| 2015/0103060 | A1 | 4/2015 | Yamashita et al. |

FOREIGN PATENT DOCUMENTS

| | | | |
|---|---|---|---|
| JP | 2008-233123 | A | 10/2008 |
| JP | 2008-233124 | A | 10/2008 |
| JP | 2008-310127 | A | 12/2008 |
| JP | 2011-248218 | A | 12/2011 |
| JP | 2014-170092 | A | 9/2014 |

* cited by examiner

ELECTRO-OPTICAL DEVICE AND ELECTRONIC APPARATUS

BACKGROUND

1. Technical Field

The present disclosure relates to an electro-optical device and an electronic apparatus.

2. Related Art

JP-A-2014-170092 discloses an example of a technology for preventing display unevenness in a case where a high drive voltage drives a fine pixel in an electro-optical device. The electro-optical device described in JP-A-2014-170092 reduces occurrence of the display unevenness by reducing amplitudes of gate signals of a plurality of transistors included in a pixel circuit, or the like.

In addition, JP-A-2008-233124, JP-A-2008-191295, and JP-A-2006-39572 describe a configuration in which display unevenness is prevented by using different power supplies for a pixel circuit portion and a peripheral circuit portion. According to the configuration, problems are solved in which the pixel circuit is affected by a voltage change due to an operation of the peripheral circuit portion and thus display quality is degraded, in a case where a common power supply is used for the pixel circuit portion including a plurality of pixel circuits and the peripheral circuit portion (scan line drive control unit or the like).

However, in the configuration described in JP-A-2008-233124, JP-A-2008-191295, and JP-A-2006-39572, power supplies different from each other are required for the pixel circuit portion and the peripheral circuit portion. Hence, the number of power supplies increases, and thereby, the number of terminals increases. In addition, an increase of the number of power supplies causes a decrease of power supplying capability, and thus, there is a possibility that display unevenness occurs.

SUMMARY

An advantage of some aspects of the embodiment is to provide an electro-optical device and an electronic apparatus which can prevent display unevenness from occurring without increasing the number of power supplies.

According to an aspect of the embodiment, an electro-optical device includes a display unit that includes a plurality of pixel circuits which are arranged in a lattice shape in a row direction and a column direction; a scan line drive circuit that scans the plurality of pixel circuits in the column direction by supplying a predetermined control signal including at least one scan signal to each of the pixel circuits which are arranged in the row direction among the plurality of pixel circuits; a first power supply line that supplies a first operation voltage to at least one pixel circuit among the plurality of pixel circuits; a second power supply line that supplies a second operation voltage to the scan line drive circuit, and is disposed separately from a portion of the first power supply line which is located within a region where the plurality of pixel circuits are arranged; and a third power supply line that is disposed separately from a portion of the second power supply line which is located within a region where the scan line drive circuit is disposed, in which the scan line drive circuit includes a logic circuit that generates the control signal and an output circuit that outputs the control signal to at least one pixel circuit of the plurality of pixel circuits, and in which the third power supply line supplies the first operation voltage to the output circuit from the first power supply line.

According to the configuration, display unevenness can be prevented from occurring without increasing the number of power supplies.

In addition, according to the aspect of the embodiment, the electro-optical device further includes a display circuit that includes the display unit, the scan line drive circuit, the first power supply line, the second power supply line, and the third power supply line; and a substrate that is connected to the display circuit through a terminal portion and includes a fourth power supply line which is connected to the first power supply line and the second power supply line through a branch point around the terminal portion.

According to the configuration, display unevenness can be prevented from occurring without increasing the number of power supplies, and a configuration of an external circuit on the substrate which is connected through a terminal portion can be simplified.

In addition, according to the aspect of the embodiment, the electro-optical device further includes a fifth power supply line that is connected to each of the first power supply line and the second power supply line, in which a branch point where the first power supply line and the second power supply line branch off from the fifth power supply line is disposed on an outside of a region where each element configuring the display unit is disposed and a region where each element configuring the scan line drive circuit is disposed.

According to the configuration, display unevenness can be prevented from occurring without increasing the number of power supplies, and a configuration of a connection portion can be simplified.

In addition, according to another aspect of the embodiment, an electro-optical device includes a display unit that includes a plurality of pixel circuits which are arranged in a lattice shape in a row direction and a column direction; a scan line drive circuit that scans the plurality of pixel circuits in the column direction by supplying a predetermined control signal including at least one scan signal to each of the pixel circuits which are arranged in the row direction among the plurality of pixel circuits; a first power supply line; and a second power supply line, in which the scan line drive circuit includes a logic circuit that generates the control signal and an output circuit that outputs the control signal to at least one pixel circuit of the plurality of pixel circuits, in which the first power supply line supplies a common first operation voltage to at least one pixel circuit of the plurality of pixel circuits and the output circuit, and in which the second power supply line supplies a second operation voltage to the logic circuit.

According to the configuration, the number of power supplies can be reduced, the first power supply line for the pixel circuit is separated from the second power supply line for the logic circuit of the scan line drive circuit, and display unevenness can be prevented from occurring.

In addition, according to still another aspect of the embodiment, in the electro-optical device, the first operation voltage is supplied to the plurality of pixel circuits as a substrate potential of transistors configuring each of the plurality of pixel circuits.

According to the configuration, display unevenness can be prevented from occurring.

In addition, according to still another aspect of the embodiment, an electronic apparatus includes the electro-optical device.

According to the configuration, display unevenness can be prevented from occurring without increasing the number of power supplies.

BRIEF DESCRIPTION OF THE DRAWINGS

The embodiment will be described with reference to the accompanying drawings, wherein like numbers reference like elements.

DESCRIPTION OF EXEMPLARY EMBODIMENTS

First Embodiment

Figure 1:
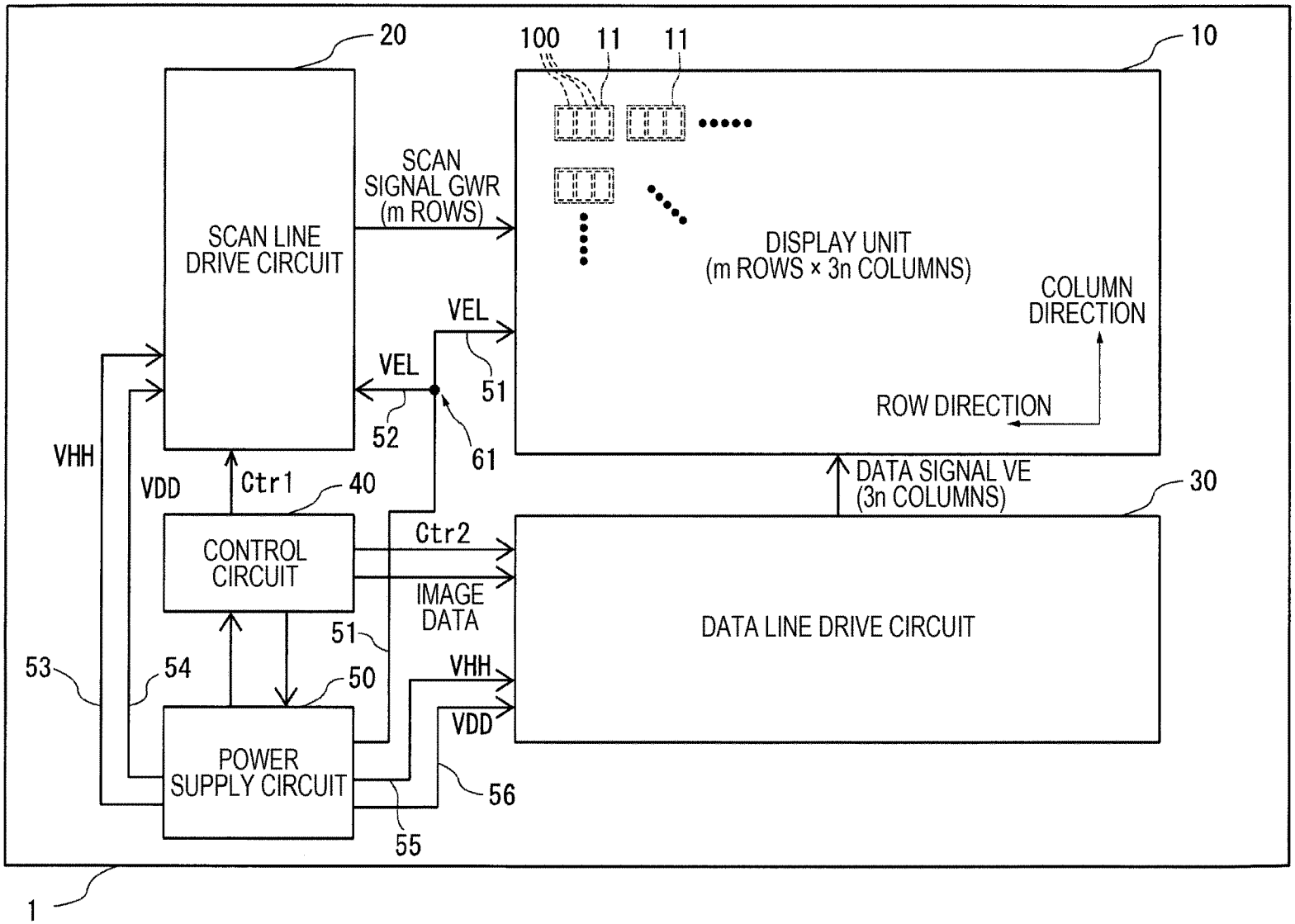
FIG. 1 is a diagram illustrating a configuration of an electro-optical device according to a first embodiment.

Hereinafter, a first embodiment according to the invention will be described with reference to the drawings. FIG. 1 illustrates a configuration example of an electro-optical device according to the first embodiment. An electro-optical device 1 includes a display unit 10, a scan line drive circuit 20, a data line drive circuit 30, a control circuit 40, and a power supply circuit 50. The display unit 10, the scan line drive circuit 20, the data line drive circuit 30, the power supply circuit 50, and a temperature sensor 60 are formed on a semiconductor substrate such as a silicon substrate. At least a part of the control circuit 40 may be formed on the semiconductor substrate such as the silicon substrate.

The display unit 10 includes a plurality of pixel circuits 100 which are arranged in a lattice shape in a row direction and a column direction. The pixel circuit 100 includes an organic light emitting diode (OLED) as a light emitting element. The plurality of pixel circuits 100 have the same configuration as each other. Scan signals GWR for m (m is an integer greater than or equal to 2) rows are supplied to the display unit 10 from the scan line drive circuit 20, and data signals VE for 3n (n is an integer greater than or equal to 2) columns are supplied to the display unit 10 from the data line drive circuit 30. 3n wires which supply the data signals VE are arranged to extend in the column direction in the display unit 10, and m wires which supply the scan signals GWR are arranged to extend in the row direction in the display unit 10. The respective pixel circuits 100 are arranged in portions at which wires of 3n columns supplying the data signals VE intersect wires of m rows supplying the scan signals GWR. Three pixel circuits 100 configure one pixel circuit group 11. The three pixel circuits 100 in one pixel circuit group 11 represent one dot of a pixel configuring a color image in correspondence with pixels of red (R), green (G), and blue (B), respectively.

The control circuit 40 supplies a control signal Ctr1 to the scan line drive circuit 20, and supplies a control signal Ctr2 to the data line drive circuit 30. In addition, the control circuit 40 supplies image data corresponding to the pixel of each row to each row of the data line drive circuit 30. In addition, the control circuit 40 controls various types of power supply voltages which are generated by the power supply circuit 50. The control signal Ctr1 is a vertical synchronization signal, a horizontal synchronization signal, a clock signal, or an enable signal, which is a pulse signal for controlling the scan line drive circuit 20. The control signal Ctr2 is a horizontal synchronization signal, a signal SEL, a dot clock signal DCLK, a latch pulse signal LP, or an enable signal, which is for controlling the data line drive circuit 30. Pixel data is a digital signal corresponding to a gradation value (gradation level) for each pixel in a row which is selected by the scan signal GWR from the scan line drive circuit 20.

The scan line drive circuit 20 generates the scan signal GWR for sequentially selecting to scan each pixel circuit 100 in each row during each frame period that is specified by a vertical synchronization signal, based on the control signal Ctr1. The scan line drive circuit 20 generates various types of controls signals which are supplied to each pixel circuit 100 for each row in addition to the scan signal GWR, but these are not illustrated in FIG. 1.

The data line drive circuit 30 generates the data signals VE, corresponding to gradation values of each pixel in a row selected by the scan line drive circuit 20, for 3n rows, and supplies the signals to the display unit 10, during each horizontal scan period, based on the image data and the control signal Ctr2.

The power supply circuit 50 generates to supply various types of power supply voltages necessary for each of the display unit 10, the scan line drive circuit 20, the data line drive circuit 30, and the control circuit 40. In addition, the power supply circuit 50 supplies a power supply voltage for operating the data line drive circuit 30, or a plurality of gradation reference voltages corresponding to gradation values, to the data line drive circuit 30. The power supply circuit 50 supplies a power supply voltage for operating the scan line drive circuit 20, the scan signal GWR, or various types of power supply voltages for generating control signals which are supplied to each pixel circuit 100, to the scan line drive circuit 20. In addition, the power supply circuit 50 supplies a power supply voltage for operating each pixel circuit 100 to each pixel circuit 100 which configures the display unit 10.

In the first embodiment, the power supply which is generated by the power supply circuit 50 is configured by a power supply VDD, a power supply VHH, and a power supply VEL. The supply voltages of the power supply VDD, the power supply VHH, and the power supply VEL are respectively VDD, VHH, and VEL. In addition to this, the power supply circuit 50 generates a reference voltage VSS, a negative voltage VCT of the pixel circuit 100, and the like, but these are not illustrated in FIG. 1. VDD is a low voltage (for example, 1.8 V) for logic. VHH is a high voltage (for example, 5.5 V) for logic and amplification. VEL is a supply voltage (for example, 5.5 V that is the same voltage as VHH) which is supplied to the pixel circuit 100. In the example illustrated in FIG. 1, the voltage VEL of the power supply VEL is supplied to each pixel circuit 100 of the display unit 10 from the power supply circuit 50 through a power supply line 51. In addition, a power supply line 52 is connected to the power supply line 51 at a branch point 61. The voltage VEL of the power supply VEL is supplied to an output circuit 25 (will be described with reference to FIG. 6 and FIG. 7) through a power supply line 52 in the scan line drive circuit 20. In addition, the voltage VHH of the power supply VHH is supplied to the scan line drive circuit 20 from the power supply circuit 50 through a power supply line 53. In addition, the voltage VDD of the power supply VDD is supplied to the scan line drive circuit 20 from the power supply circuit 50 through a power supply line 54. In addition, the voltage VHH of the power supply VHH is supplied to the data line drive circuit 30 from the power supply circuit 50 through a power supply line 55. In addition, the voltage VDD of the power supply VDD is supplied to the data line drive circuit 30 from the power supply circuit 50 through a power supply line 56. A portion of the power supply line 51 disposed in the display unit 10 and a portion of the power supply line 52 disposed in a plurality of output circuits 25 in the scan line drive circuit 20, are disposed separately from a portion of the power supply line 53 disposed in the scan line drive circuit 20 such that coupling formed by capacitance or the like is sufficiently decreased.

Figure 2:
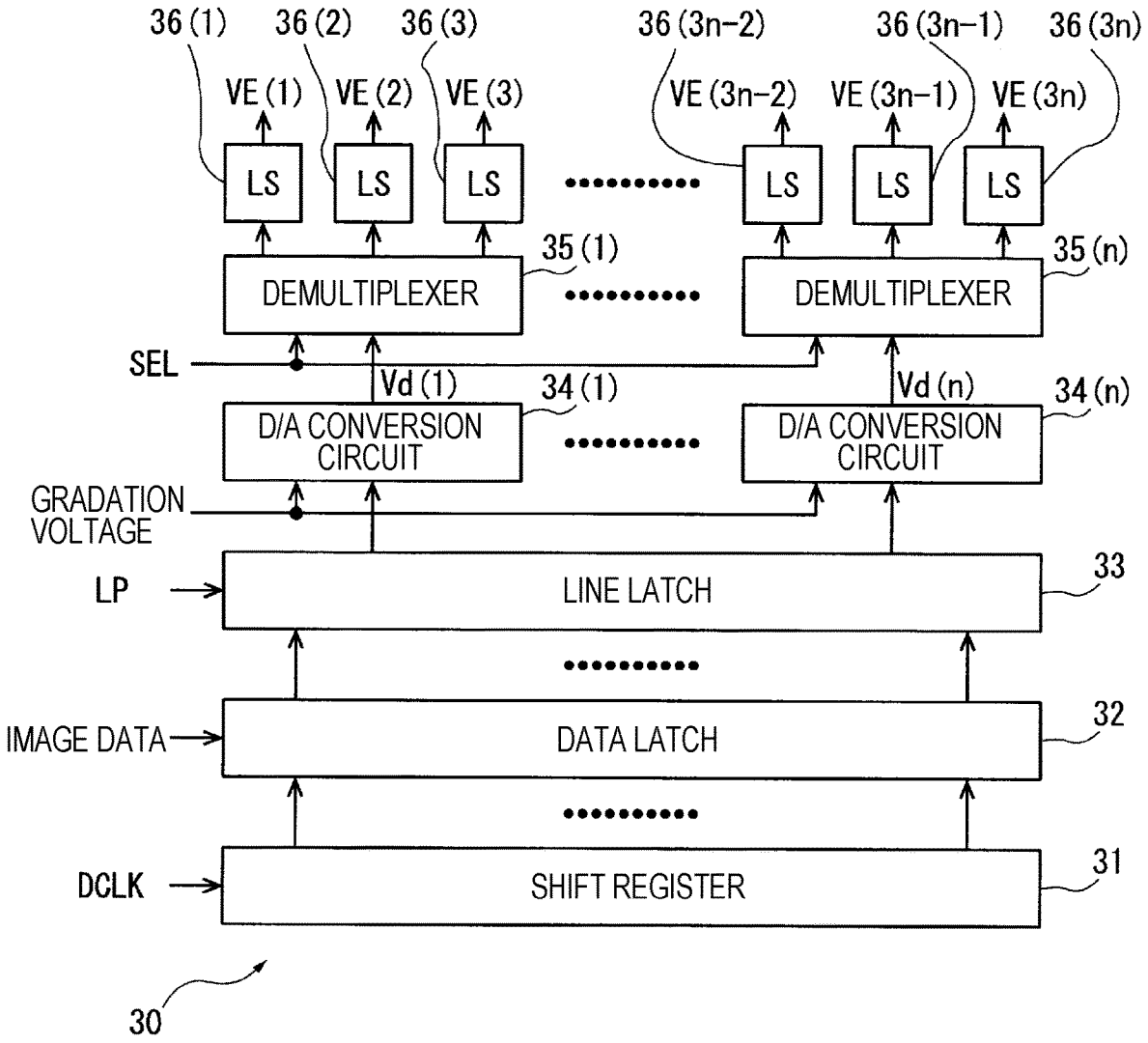
FIG. 2 is a block diagram illustrating a configuration example of a data line drive circuit illustrated in FIG. 1.

FIG. 2 is a block diagram illustrating a configuration example of the data line drive circuit 30 illustrated in FIG. 1. The data line drive circuit 30 includes a shift register 31, a data latch 32, a line latch 33, digital/analog (D/A) conversion circuits 34(1) to 34(n), demultiplexers 35(1) to 35(n), and level shift circuits 36(1) to 36(3n) provided in correspondence with the respective data signals VE(1), VE(2), VE(3), . . . , VE(3n−2), VE(3n−1), and VE(3n). Here, the data signals VE(1), VE(2), VE(3), . . . , VE(3n−2), VE(3n−1), and VE(3n) are the respective signals included in the data signals VE for 3n rows illustrated in FIG. 1.

The shift register 31 receives the dot clock signal DCLK or unillustrated take-in pulses. The shift register 31 shifts the take-in pulses in synchronization with the dot clock signal DCLK. A shift output which is obtained by shifting the take-in pulses using the shift register 31 to output is supplied to the data latch 32.

The data latch 32 receives image data synchronous to the dot clock signal DCLK or the shift output from the shift register 31. The data latch 32 takes in the image data in synchronization with the shift output from the shift register 31.

The line latch 33 receives the latch pulse signal LP or the image data taken in to the data latch 32. The line latch 33 latches the image data for one row which is taken in to the data latch 32 in synchronization with the latch pulse signal LP.

Each of the D/A conversion circuits 34(1) to 34(n) receives a gradation voltage which is a reference when the image data is converted into an analog voltage, and receives the image data latched in the line latch 33. The gradation voltage is supplied from, for example, the power supply circuit 50. Each of the D/A conversion circuits 34(1) to 34(n) generates the gradation voltage corresponding to a gradation value of the image data. The D/A conversion circuits 34(1) to 34(n) determine gradation voltages corresponding to the gradation values corresponding to the image data latched by the line latch 33, for each pixel. The D/A conversion circuits 34(1) to 34(n) supply the determined gradation voltages to corresponding demultiplexers 35(1) to 35(n) as voltages of data signals Vd(1) to Vd(n) which are obtained by multiplexing data signals of each pixel of three columns configuring one dot.

Each of the data signals Vd(1) to Vd(n) is obtained by multiplexing the data signal corresponding to the gradation value of each pixel of three columns in accordance with the select timing of the demultiplexers 35(1) to 35(n). Each demultiplexer configuring the demultiplexers 35(1) to 35(n) outputs the data signal to each column in accordance with the select timing selected by the signal SEL.

The level shift circuits 36(1) to 36(3n) level-shift by reducing a voltage range of the data signals Vd(1) to Vd(n) which are output to each column by corresponding demultiplexers 35(1) to 35(n), and output the shifted signals as the data signals VE(1) to VE(3n). That is, a voltage range of the data signals VE(1) to VE(3n) is obtained by reducing the voltage range of the data signals Vd(1) to Vd(n) and level-shifting the reduced voltage range.

Figure 3:
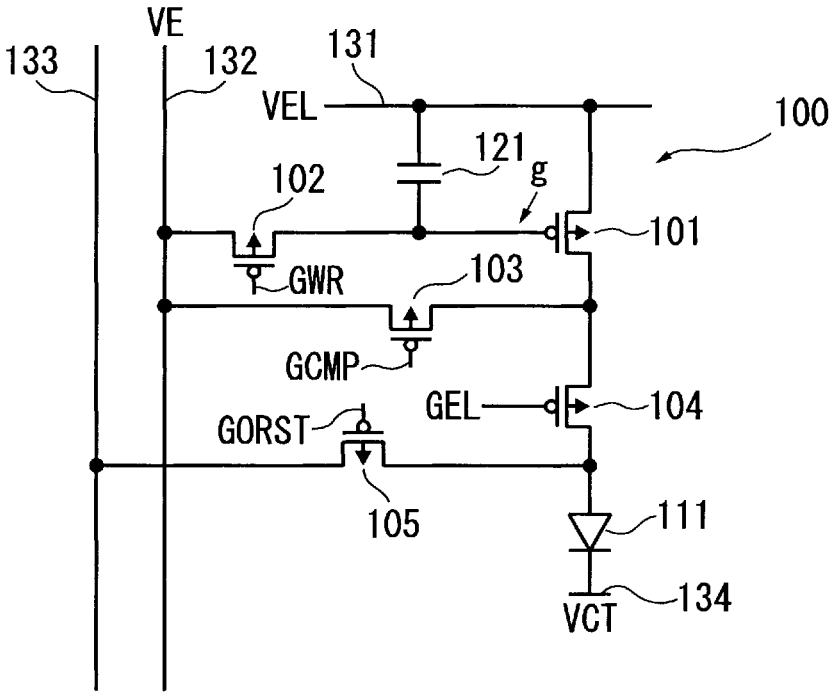
FIG. 3 is a circuit diagram illustrating a configuration example of a pixel circuit illustrated in FIG. 1.

FIG. 3 is a configuration example of the pixel circuit 100 illustrated in FIG. 1. The pixel circuit 100 includes P-channel metal oxide semiconductor field effect transistors (MOSFETS) 101 to 105 (hereinafter, referred to as transistors 101 to 105), an OLED 111, and a retention capacitor 121. The pixel circuit 100 receives the scan signal GWR, a control signal GCMP, a control signal GEL, and a control signal GORST which are supplied from the scan line drive circuit 20 and become gate signals of the transistors 102, 103, 104, and 105, respectively. The scan signal GWR, the control signal GCMP, the control signal GEL, and the control signal GORST are supplied in common to the pixel circuits 100 in the same row.

The transistor 101 is a drive transistor, has a source connected to a power supplying line 131 that is a power supply line, and has a drain connected to a source of the transistor 103 and a source of the transistor 104. In addition, a gate (node g) of the transistor 101 is connected to a drain of the transistor 102 and one terminal of the retention capacitor 121. The power supplying line 131 receives the voltage VEL on a high potential side voltage of a power supply in the pixel circuit 100. The voltage VEL is a voltage (for example, 5.5 volts) which is supplied from the power supply circuit 50 through the power supply line 51.

The transistor 102 is a write transistor (or select transistor), and has a source connected to a data line 132. A gate of the transistor 102 is controlled by the scan signal GWR which is a gate signal.

The transistor 103 is a threshold compensation transistor, and has a gate which receives the control signal GCMP. A gate of the transistor 103 is controlled by the control signal GCMP which is a gate signal.

The transistor 104 is a current supply control transistor, has a drain connected to an anode of the OLED 111 and a source of the transistor 105, and a gate which receives the control signal GEL. A gate of the transistor 104 is controlled by the control signal GEL which is a gate signal. By providing transistor 104, a current is supplied to the OLED 111, for example, shortly after the power is supplied, and thereby, it is possible to avoid circumstances in which an unintended image is displayed.

The transistor 105 is a reset transistor, has a drain connected to a power supplying line 133, and a gate which receives the control signal GORST. A gate of the transistor 105 is controlled by the control signal GORST which is a gate signal. In FIG. 3, the voltage VEL is supplied as a substrate potential (back gate potential) of the transistors 101 to 105. The voltage VEL is a highest potential of the pixel circuit 100.

A cathode of the OLED 111 receives the voltage VCT on a low potential side voltage of the power supply in the pixel circuit 100 through a power supplying line 134 configuring a common electrode as a power supply line. The voltage VCT can be set to a voltage of the same potential as a ground voltage VSS (for example, 0 volt). The OLED 111 is a light emitting element that is configured by interposing a white organic EL layer between an anode and a cathode with light-transmitting properties on a silicon substrate. Any one color filter of R, G, and B is disposed to overlap in a cathode of the OLED 111 on an emission side. If a current flows from the anode of the OLED 111 to the cathode of the OLED, holes injected from the anode recombines with electrons injected from the cathode in an organic EL layer, excitons are generated, and, white light is generated. After passing through the cathode, the white light is colored by the color filter and is viewed by an observer. Light which is emitted from the OLED 111 is not limited to white light, and may be any one of red light, blue light, and green light, and may be light with other colors.

The other terminal which is not connected to the drain of the transistor 102 of the retention capacitor 121 is connected to the power supplying line 131, and the retention capacitor 121 retains a gate-source voltage of the transistor 101. A parasitic capacitor of the gate of the transistor 101 may be used, or a capacitor which is formed by interposing an insulating layer between conductive layers may be used, as the retention capacitor 121.

Figure 5:
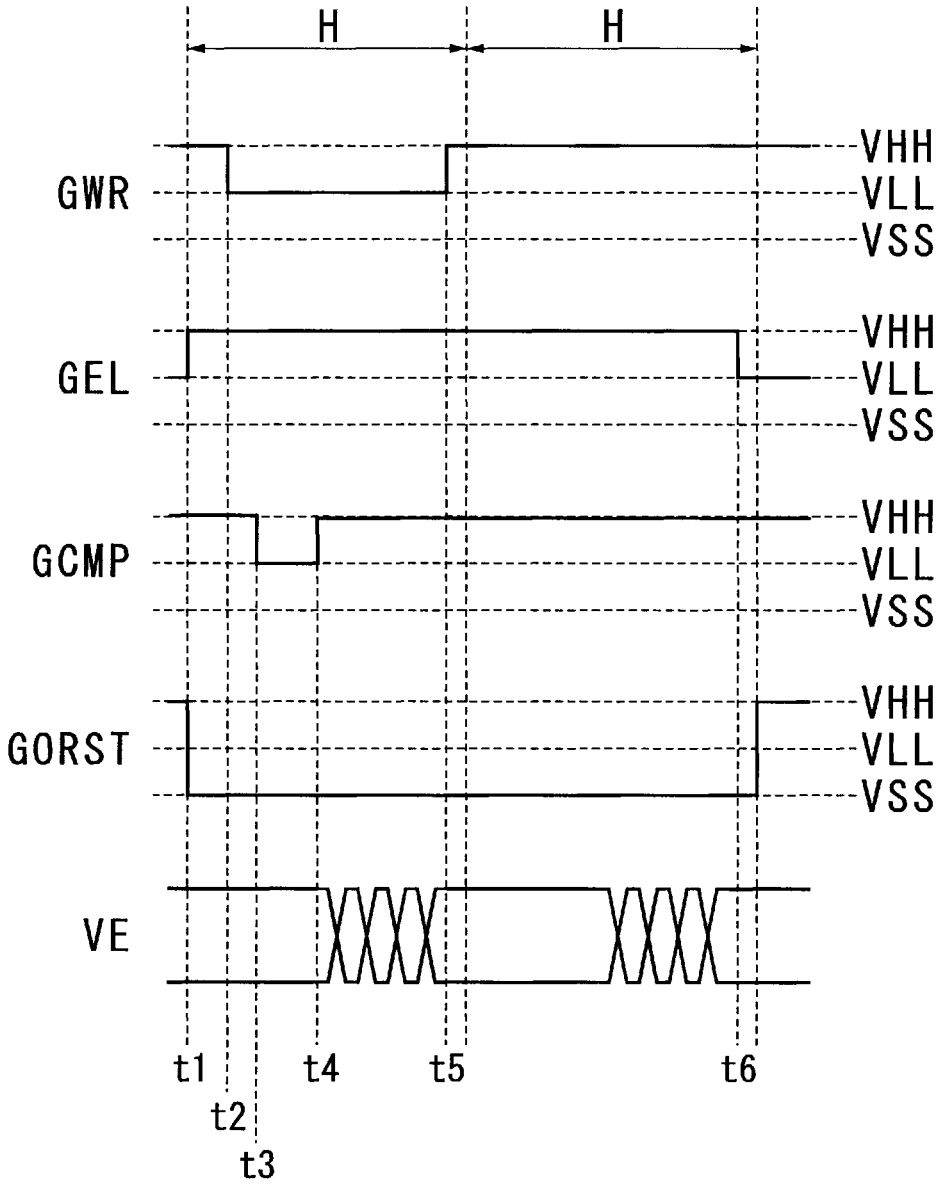
FIG. 5 is a timing diagram illustrating an operation example of the pixel circuit illustrated in FIG. 3.

Next, a drive example of the pixel circuit 100 illustrated in FIG. 3 will be described with reference to FIG. 5. FIG. 5 illustrates an example of a timing diagram corresponding to a drive method of the pixel circuit 100 according to the first embodiment. The scan line drive circuit 20 illustrated in FIG. 1 changes the scan signal GWR into an L level in each row during each horizontal scan period (H) within one frame period, thereby sequentially scanning each row in each horizontal scan period (H). An operation in one horizontal scan period is performed in common in the pixel circuit 100 of each row. In the first embodiment, an H level voltage VHH of the scan signal GWR, the control signal GCMP, and the control signal GEL is the voltage VEL, and an L level voltage VLL thereof is a voltage V33. In a case where, an H level voltage of logic circuits included in the scan line drive circuit 20, the data line drive circuit 30, the control circuit 40, and the like is set to the voltage VDD (for example, 1.8 volts), the voltage V33 is a voltage (for example, 3.3 volts) which is VDD<V33<VHH. The H level voltage VHH of the control signal GORST is the voltage VEL, and an L level voltage is a ground voltage VSS.

Before horizontal scan period (H) starts (before t1), the scan signal GWR has an H level, the control signal GEL has an L level, the control signal GCMP has an H level, and the control signal GORST has an H level. Hence, in the pixel circuit 100, the transistor 104 is turned on, and transistors 102, 103, and 105 are turned off. At this time, the transistor 101 supplies a current according to the gate-source voltage retained in the retention capacitor 121 to the anode of the OLED 111 through the transistor 104.

Next, if the horizontal scan period (H) starts, the control signal GEL goes to an H level, and the control signal GORST goes to an L level (ground voltage VSS) (time t1). Hence, in the pixel circuit 100, the transistor 104 is turned off, and the transistor 105 is turned on. Thereby, a reset voltage VORST which is supplied to the power supplying line 133 is applied to the anode of the OLED 111. In the OLED 111, unillustrated parasitic capacitors Coled exist in parallel between the anode and cathode, and thus, when the transistor 105 is turned on, an anode-cathode voltage retained in the parasitic capacitor Coled is initialized. Since the anode voltage of the OLED 111 is initialized, when the current flows through the OLED 111 again during a subsequent light emission period, the current may not be affected by a voltage retained in the parasitic capacitor Coled. For example, in a case where transition from a light emission state of high luminance to a light emission state of low luminance is performed, a high voltage is retained in the parasitic capacitor Coled after a large current flows, and thus, even if a small current flows, the current is excessive, and thereby, a light emission state in desired low luminance may not be realized. In contrast to this, according to the first embodiment, the anode voltage of the OLED 111 is initialized before the light emission period, and thus, even in a case where transition from a light emission state of high luminance to a light emission state of low luminance is performed, it is possible to increase reproducibility on low luminance side. In the first embodiment, a difference between the voltage VCT and the reset voltage VORST is set to be less than a light emission threshold voltage of the OLED 111, and thus, when being initialized, the OLED 111 enters a light non-emission state.

Next, the scan signal GWR goes to an L level (time t2), and subsequently, the control signal GCMP goes to an L level (time t3). Hence, at time t3, the transistors 102 and 103 are turned on, and thus, the gate of the transistor 101 is electrically connected to the data line 132. At this time, the transistor 101 is diode-connected because gate and drain thereof are short-circuited, and thereby, a current flows through a path formed in the sequence of the power supplying line 131, the transistor 101, the transistor 103, the data line 132, and the transistor 102, and thereby, the node g and the data line 132 are electrically charged. If a threshold voltage of the transistor 101 is referred to as Vth1, a voltage of the node g and the data line 132 is subsequently saturated by (VEL−|Vth1|) after time passes, and the retention capacitor 121 is in a state of retaining the threshold voltage |Vth1| of the transistor 101.

Next, the control signal GCMP goes to an H level (time t4). Hence, in time t4, the transistor 103 in the pixel circuit 100 is turned off. Subsequently, during a write period of the time t4 to time t5, if the data signal VE is output to the data line 132, the data line 132 and the node g in which (VEL−|Vth1|) is retained by the retention capacitor 121 have a voltage with a value (VEL−|Vth1|+ΔV) which is changed in an increasing direction by the amount of voltage change ΔV of the data signal VE.

After the write period ends (after time t5), the light emission period starts after one horizontal scan period passes (time t6). During the light emission period after the time t6, the control signal GEL goes to an L level, and thus, the transistor 104 is turned on. At this time, a gate-source voltage Vgs of the transistor 101 becomes VEL−(VEL−|Vth1|+ΔV)=(|Vth1|−ΔV). If an amplification factor is referred to as β, a drain current Id of the transistor 101 is determined by $Id=(-\frac{1}{2})\cdot\beta\cdot(Vgs-|Vth1|)^2$, and thus, the OLED 111 receives a current according to a gradation value in a state where a threshold voltage of the transistor 101 is compensated for.

Next, a configuration example of the scan line drive circuit 20 illustrated in FIG. 1 will be described with reference to FIG. 6. The scan line drive circuit 20 illustrated in FIG. 6 includes a select circuit 21, a plurality of logic circuits 22, a plurality of level shift circuits 23, a plurality of buffer circuits 24, and a plurality of output circuits 25. Each logic circuit 22 generates the respective control signals GWR, GCMP, GORST, and GEL described with reference to FIG. 3, based on the control signal Ctr1 supplied from the control circuit 40. The control signal GWR of these control signals is a scan signal. Each control signal generated by each logic circuit 22 is input to each corresponding level shift circuit 23. Each level shift circuit 23 converts a digital signal, which is output from each logic circuit 22 and in which an H level is VDD and an L level is VSS into a digital signal in which an H level is VHH and an L level is VSS. Each control signal that each level shift circuit 23 level-converts is input to each corresponding buffer circuit 24. Each buffer circuit 24 has, for example, an output stage with high current drive capability at a low output impedance, converts the digital signal that each level shift circuit 23 outputs into a digital signal suitable for an input signal of the output circuit 25, and outputs the converted digital signal to each corresponding output circuit 25. Each output circuit 25 uses the voltage VEL of the power supply VEL supplied through the power supply line 52 as an operation voltage, and converts a digital signal, which is supplied from each buffer circuit 24 and in which an H level is VHH and an L level is VSS, into a digital signal in which an H level is a VEL and an L level is VLL to output. In a case where the output circuit 25 outputs the scan signal GWR, the control signal GEL, and the control signal GCMP which are illustrated in FIG. 5, an L level of an output signal is VLL, but in a case where the output circuit 25 outputs the control signal GORST, the L level of the output signal is VSS. The select circuit 21 inputs a predetermined control signal to the logic circuit 22 in correspondence with vertical scan timing or the like, and controls timing when each control signal which is output from the output circuit 25 is generated.

Figure 6:
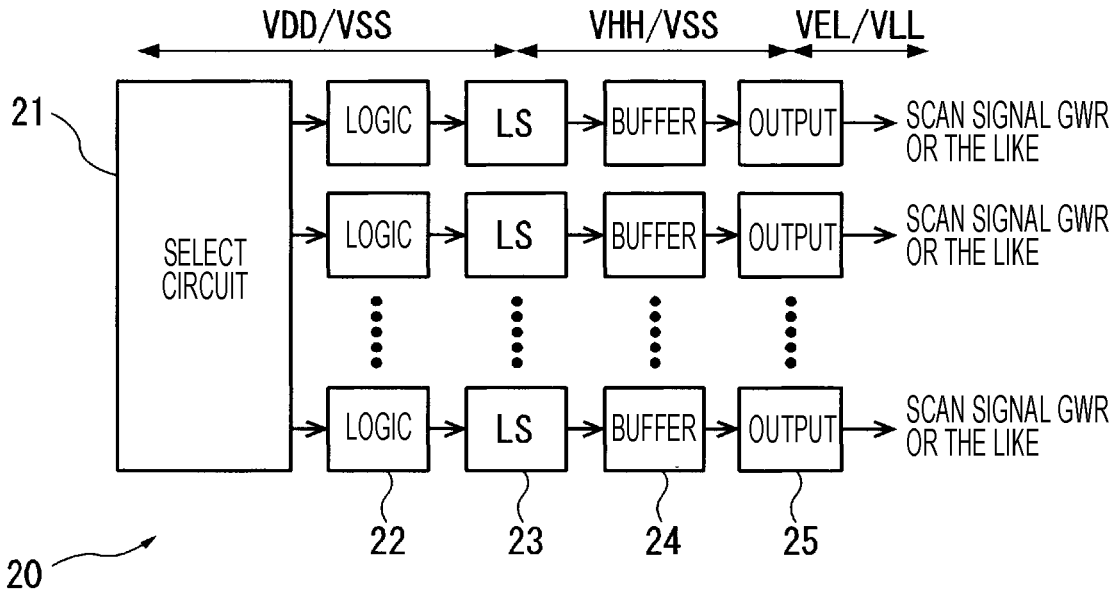
FIG. 6 is a block diagram illustrating a configuration example of a scan line drive circuit illustrated in FIG. 1.
Figure 7:
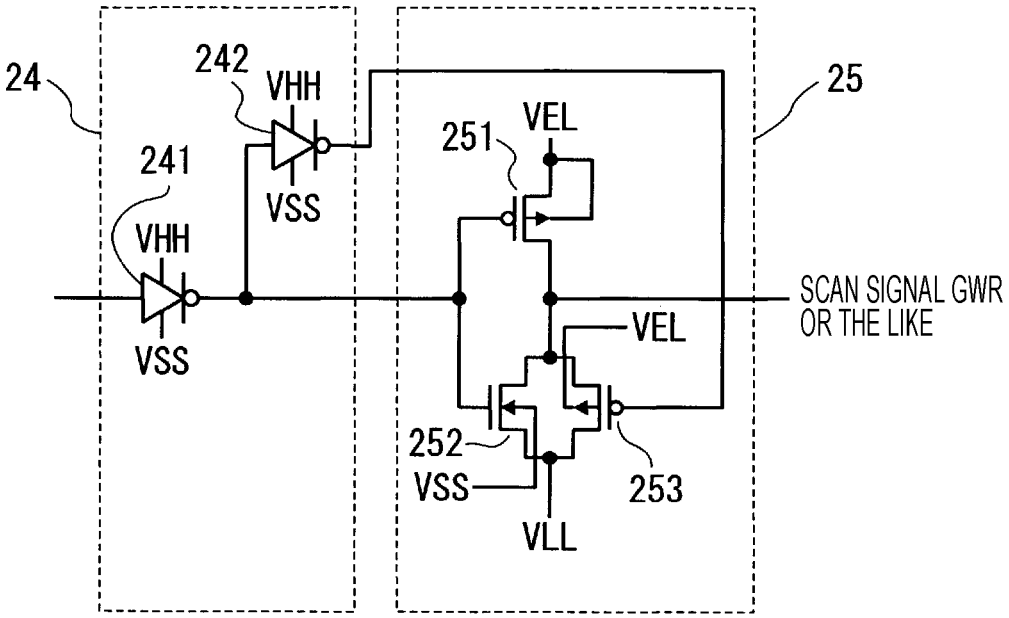
FIG. 7 is a circuit diagram illustrating a configuration example of an output circuit illustrated in FIG. 6.

A configuration example of the buffer circuit 24 and the output circuit 25 which are illustrated in FIG. 6 will be described with reference to FIG. 7. In the configuration example illustrated in FIG. 7, the buffer circuit 24 includes two the inverter circuits 241 and 242. The output circuit 25 includes a P-channel MOSFET 251, an N-channel MOSFET 252, and a P-channel MOSFET 253 (hereinafter, referred to as transistors 251, 252, and 253). The inverter circuits 241 and 242 of the buffer circuit 24 operate by using VHH and VSS as power supply voltages. An input of the inverter circuit 241 is connected to an output of the level shift circuit 23 illustrated in FIG. 6. An output of the inverter circuit 241 is connected to an input of the inverter circuit 242, a gate of the transistor 251, and a gate of the transistor 252. A source and a back gate of the transistor 251 receive the voltage VEL through the power supply line 52, and a drain of the transistor 251 is connected to a drain of the transistor 252 and a source of the transistor 253. A source of the transistor 252 and a drain of the transistor 253 receive the voltage VLL. A back gate of the transistor 252 receives the voltage VSS, and a back gate of the transistor 253 receives the voltage VEL. In addition, a gate of the transistor 253 is connected to an output of the inverter circuit 242. By the aforementioned configuration, a digital signal, which is input to the inverter circuit 241 of the buffer circuit 24 and in which an H level is VHH and an L level is VSS, is converted into a digital signal in which an H level is VEL and an L level is VLL, and is output from a connection point between a drain of the transistor 251 and a drain of the transistor 252 of the output circuit 25.

As described above, in the first embodiment, the power supply voltage VEL of the output circuit 25 in the scan line drive circuit 20 is used in common with the power supply voltage VEL of the pixel circuit 100. According to this configuration, a voltage change which is caused by operations of the logic circuit 22, the level shift circuit 23, the buffer circuit 24 and the like in the scan line drive circuit 20, or caused by an operation of the data line drive circuit 30 causes a voltage of, for example, the scan signal GWR to decrease, and affects an operation of the pixel circuit 100. It is possible to overcome the possibility in which display quality may be degraded. In addition, the pixel circuit 100 and the scan line drive circuit 20 do not need power supplies different from each other, and thus, an increase of the number of power supplies or an increase of the number of terminals according to the increase of the number of power supplies does not occur. That is, according to the first embodiment, display unevenness is prevented from occurring without increasing the number of power supplies, that is, it is possible to prevent image quality from being degraded due to noise of an internal peripheral circuit or a decrease of the power supply voltages caused by power consumption.

Hereinafter, effects of the first embodiment will be further described. For example, if the voltage VEL to the pixel circuit 100 is used in common with VHH differently from the first embodiment, image quality may be degraded due to power consumption of the data line drive circuit 30 and the scan line drive circuit 20, or due to being affected by noise. For example, when data is written, that is, when data is written from the D/A conversion circuits 34(1) to 34(n), a large charging or discharging current flows through the retention capacitor 121. Thereby, an excessive current change occurs, and thereby, a retention voltage of the pixel circuit 100 changes during light emission and flicker or blinking occurs. Accordingly, it is preferable that the power supply of the pixel circuit 100 differ from the power supply of the peripheral circuit (that is, it is preferable that VHH differ from VEL).

Figure 4:
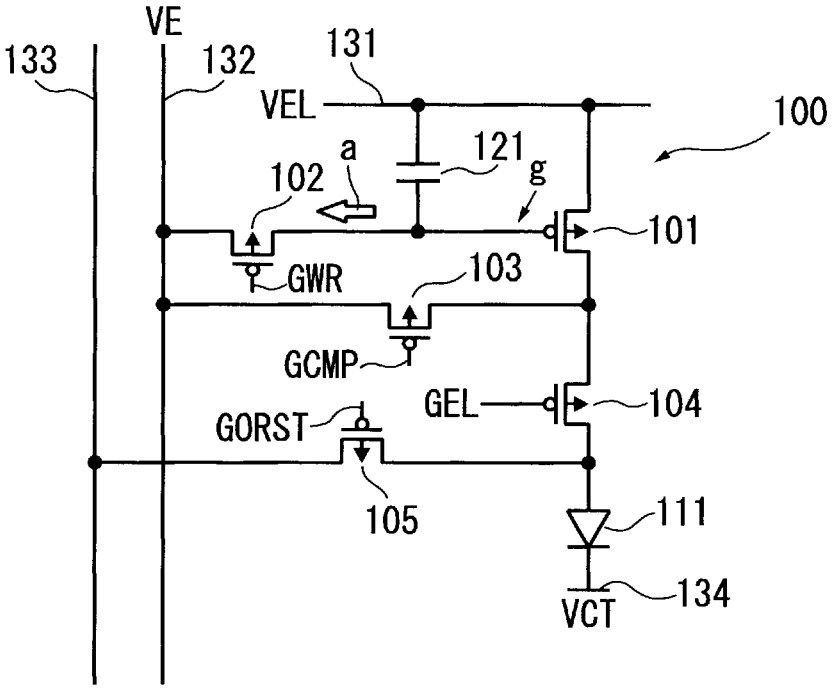
FIG. 4 is diagram illustrating an operation example for comparing with an operation according to the first embodiment of the pixel circuit illustrated in FIG. 1.

However, if there is a potential difference between a reference voltage VEL and the control voltage VHH in the pixel circuit 100, a problem occurs in which data is not retained. For example, in the pixel circuit 100 illustrated in FIG. 4, in a case where an output voltage of the scan signal GWR is VHH and there is much power consumption of a peripheral circuit, a potential difference between VHH and VEL occurs due to dropping of an internal voltage. For example, in a case where there is much power consumption of the peripheral circuit, VHH<VEL is satisfied. Since the gate voltage VHH is lower than the reference voltage VEL, the transistor 102 of the pixel circuit 100 is not fully turned off in a light emission state in which data is retained, and is turned on by $\Delta V = VHH - VEL$. As a result, a leakage current denoted by an arrow a increases, and thereby, data is not able to be retained, and display degradation such as crosstalk occurs.

In contrast to this, in the first embodiment, a logic voltage of the output circuit 25 of the scan line drive circuit 20 is used as the power supply voltage VEL of the pixel circuit 100. Thereby, a voltage difference between a light emission voltage and the logic voltage is reduced within the pixel circuit 100, and thus, the circuit is not affected by a peripheral circuit and displaying is prevented from being degraded.

As described above, in the first embodiment, the display unit 10 having a plurality of the pixel circuits 100 which are arranged in a lattice shape in a row direction and a column direction, and the scan line drive circuit 20 which scans the plurality of the pixel circuits 100 arranged in the row direction in the column direction and supplies a predetermined control signal including at least the scan signal GWR to each row, are provided. The scan line drive circuit 20 includes at least the logic circuit 22 which generates a control signal, a logic circuit such as the buffer circuit 24, and the output circuit 25 which outputs the control signal to the pixel circuit 100. In addition, the electro-optical device 1 according to the first embodiment further includes the power supply line 51 (first power supply line) which supplies the voltage VEL (first operation voltage) to the pixel circuit 100, the power supply line 53 (second power supply line) which supplies the voltage VHH (second operation voltage) to the scan line drive circuit 20 and is disposed separately from a portion of the power supply line 51 which is located within the pixel circuit 100, and the power supply line 52 (third power supply line) which supplies the voltage VEL from the power supply line 51 to the output circuit 25 and is disposed separately from a portion of the power supply line 53 which is located within the scan line drive circuit 20. According to this configuration, even if the voltage VHH is changed in accordance with an operation of the periphery circuit, an off voltage of a gate signal of each transistor in the pixel circuit 100 is not affected. Hence, according to the first embodiment, display unevenness is prevented from occurring without increasing the number of power supplies.

Second Embodiment

Figure 8:
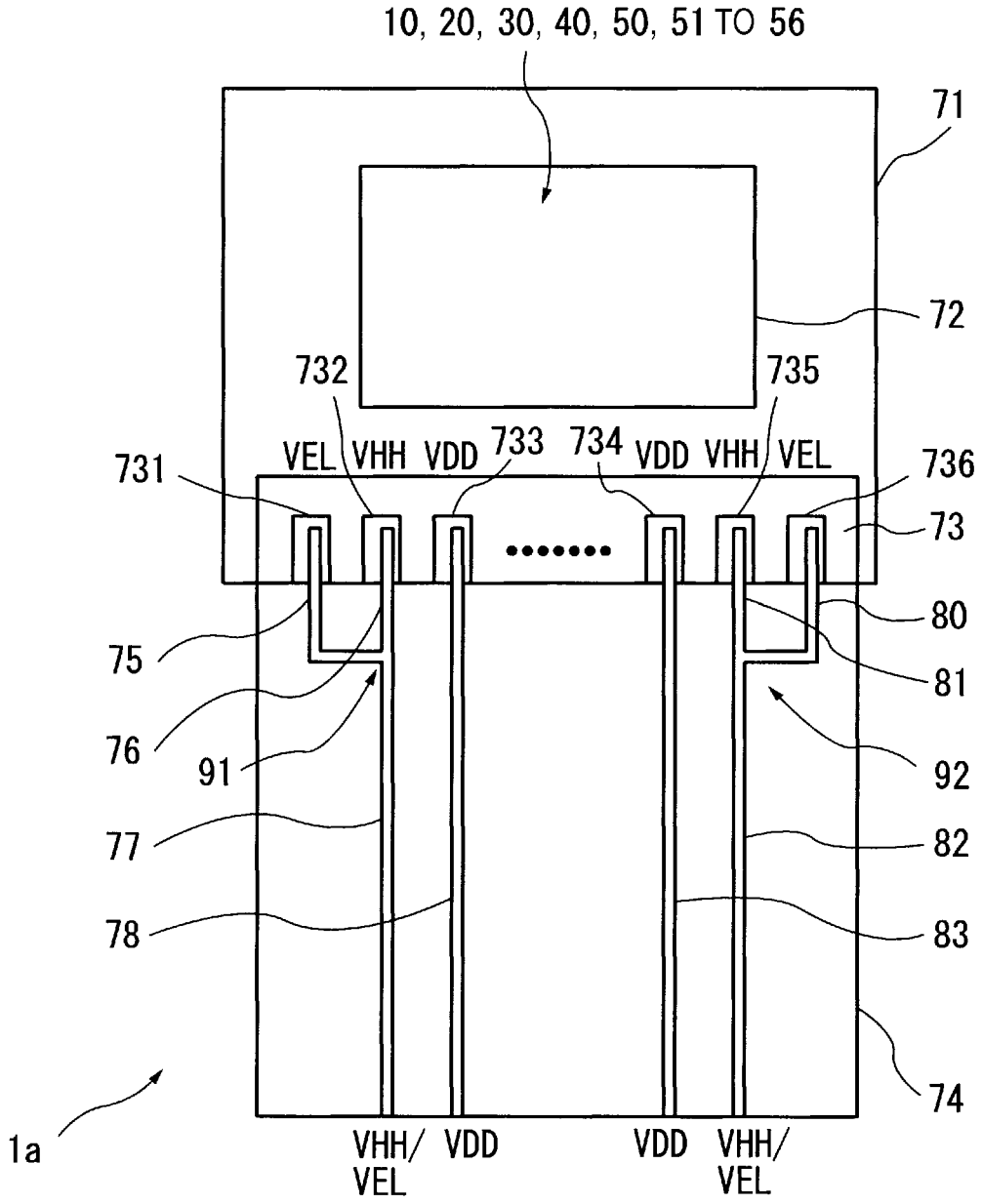
FIG. 8 is a diagram illustrating a configuration of an electro-optical device according to a second embodiment.

Next, a second embodiment will be described with reference to FIG. 8. In FIG. 8, the same symbols or reference numerals will be attached to the same or equivalent configuration elements as in FIG. 1. FIG. 8 is illustrates a configuration example of an electro-optical device 1*a* according to the second embodiment. The electro-optical device 1*a* includes a display circuit 71, a circuit block 72, and an external substrate 74. The display circuit 71 configures a display panel or the like, and includes the circuit block 72 and a plurality of connection terminals of a terminal portion 73. The circuit block 72 includes the display unit 10, the scan line drive circuit 20, the data line drive circuit 30, the control circuit 40, the power supply circuit 50, and the power supply lines 51 to 56, which are illustrated in FIG. 1. However, the circuit block 72 may not include a part or the entirety of the configuration of the power supply circuit 50, and the external substrate 74 may include a part or the entirety of the configuration of the power supply circuit 50.

The terminal portion 73 includes connection terminals 731 to 736 and a plurality of connection terminals which are not illustrated, and connects a plurality of power supply lines and signal lines which are included in the display circuit 71 to a plurality of power supply lines and signal lines which are included in the external substrate 74. In the example illustrated in FIG. 8, the terminal portion 73 connects the power supply lines 51 and 52 (refer to FIG. 1) of the voltage VEL included in the display circuit 71 to power supply lines 75 and 80 of the voltage VEL included in the external substrate 74 through the connection terminals 731 and 736. In addition, the terminal portion 73 connects the power supply lines 53 and 55 (refer to FIG. 1) of the voltage VHH included in the display circuit 71 to power supply lines 76 and 81 of the voltage VHH included in the external substrate 74 through the connection terminals 732 and 735. In addition, the terminal portion 73 connects the power supply lines 54 and 56 (refer to FIG. 1) of the voltage VDD included in the display circuit 71 to power supply lines 78 and 83 of the voltage VDD included in the external substrate 74 through the connection terminals 733 and 734. In the example, a voltage value of the voltage VEL is the same as a voltage value of the voltage VHH.

The external substrate 74 includes a plurality of power supply lines configured on, for example, a flexible print substrate (FPC), and a plurality of external circuits functioning as a peripheral circuit of the circuit block 72. The external circuits included in the external substrate 74 operate by using each voltage which is supplied through power supply lines 77, 78, 82 and 83 as a power supply. In this case, the power supply line 77 is connected to power supply lines 75 and 76 at a branch point 91 disposed around the terminal portion 73. The power supply line 77 supplies a voltage according to the voltage VEL of the power supply line 75 or the voltage VHH of the power supply line 76. In the same manner, the power supply line 82 is connected to power supply lines 80 and 81 at a branch point 92 disposed around the terminal portion 73. The power supply line 82 supplies a voltage according to the voltage VEL of the power supply line 80 or the voltage VHH of the power supply line 81. In addition, the power supply lines 78 and 83 supply the voltage VDD. In this case, for example, the power supply line 77 is connected to the power supply line 51 of the voltage VEL and the power supply line 53 of the voltage VHH in the circuit block 72 through the branch point 91 around the terminal portion 73.

As described above, in the electro-optical device 1*a* according to the second embodiment, the voltage VEL and the voltage VHH within the display circuit 71 are divided at the branch point 91 or 92 connected to an external portion of the display circuit 71 through the connection terminals 731, 732, 735 and 736 included in the terminal portion 73. According to this configuration, a control signal on the external substrate 74 becomes one system of, for example, VEL=VHH=5.5 V, and thus, a configuration of an external circuit can be simplified. That is, the electro-optical device 1*a* according to the second embodiment includes the display circuit 71 including the display unit 10, the scan line drive circuit 20, the power supply line 51 (first power supply line), the power supply line 53 (second power supply line), and the power supply line 52 (third power supply line), and the external substrate 74 which is connected to the display circuit 71 through the terminal portion 73 and includes the power supply line 77 or 82 (fourth power supply line) which is connected to the power supply line 51 (first power supply line) and the power supply line 53 (second power supply line) through the branch point 91 or 92 around the terminal portion 73. According to this configuration, there is an effect in which a configuration of an external circuit can be simplified, in addition to the effects of the first embodiment in which display unevenness is prevented from occurring without increasing the number of power supplies.

The branch points 91 and 92 may be provided on the external substrate 74 and may be provided in the terminal portion 73, when being disposed around the terminal portion 73.

Third Embodiment

Figure 9:
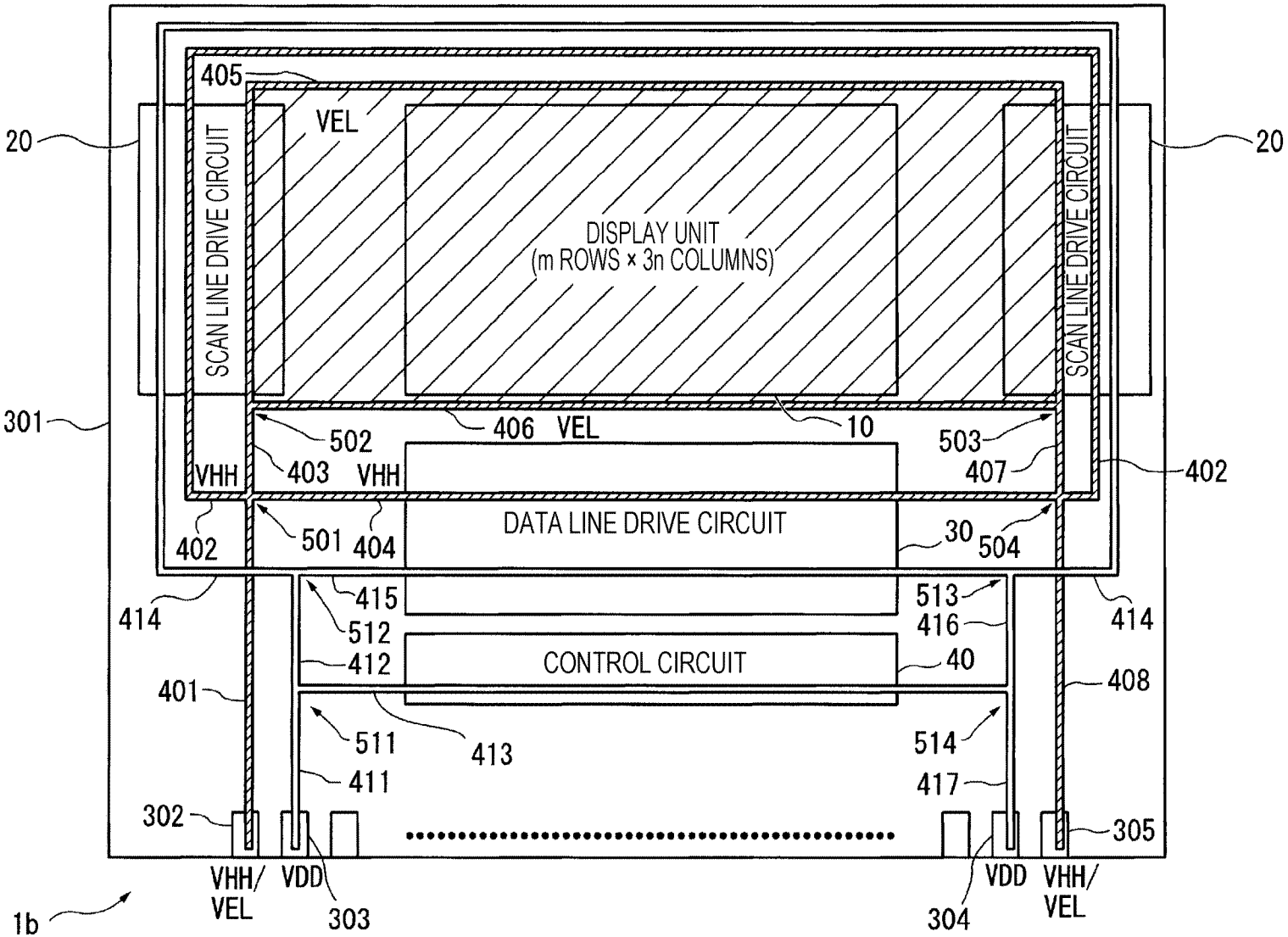
FIG. 9 is a diagram illustrating a configuration of an electro-optical device according to a third embodiment.

Next, a third embodiment will be described with reference to FIG. 9. In FIG. 9, the same symbols or reference numerals will be attached to the same or equivalent configuration elements as in FIG. 1. FIG. 9 illustrates an electro-optical device 1*b* according to the third embodiment. FIG. 9 is a plan view schematically illustrating regions and disposition of each circuit block, and disposition (layout) of each power supply line, which are included in the electro-optical device 1*b*. The electro-optical device 1*b* includes the display unit 10, the scan line drive circuits 20 which are divided into two locations to be disposed, the data line drive circuit 30, the control circuit 40, the unillustrated power supply circuit 50, power supply lines 401 to 408, and power supply lines 411 to 417, which are provided on a semiconductor substrate 301. However, differently from the first embodiment, a part or the entirety of the configuration of the power supply circuit 50 is omitted, and in this case, the voltage VHH or VEL and the voltage VDD are supplied from an external portion of the electro-optical device 1*b* through terminals 302 and 305, and terminals 303 and 304.

The power supply line 401 is connected to the terminal 302, and is connected to the power supply lines 402 to 404 at a branch point 501. A common voltage of the voltage VHH and the voltage VEL is input to the power supply line 401 from the terminal 302. In addition, the power supply line 408 is connected to the terminal 305, and is connected to the power supply lines 402, 404, and 407 at a branch point 504. A common voltage of the voltage VHH and the voltage VEL is input to the power supply line 408 from the terminal 305.

The power supply line 402 supplies a voltage which is supplied from the power supply line 401 or the power supply line 408 to two scan line drive circuits 20 as the voltage VHH.

The power supply line 403 is connected to the power supply lines 405 and 406 at a branch point 502. The power supply line 407 is connected to the power supply lines 405 and 406 at a branch point 503. The power supply line 405 supplies a voltage which is supplied from the power supply line 403 or 407 to the two scan line drive circuits 20 as the voltage VEL. The voltage VEL which is supplied through the power supply line 405 becomes an operation voltage of the output circuit 25 illustrated in FIG. 7. In addition, the power supply lines 405 and 406 supply a voltage which is supplied through the power supply line 403 or 407 to the display unit 10 as the voltage VEL.

The power supply line 404 supplies a voltage which is supplied through the power supply line 401 or 408 to the data line drive circuit 30 as the voltage VHH.

Meanwhile, the power supply line 411 is connected to the terminal 303, and is connected to the power supply lines 412 and 413 at a branch point 511. The voltage VDD is input to the power supply line 411 from the terminal 303. In addition, the power supply line 417 is connected to the terminal 304, and is connected to the power supply lines 413 and 416 at a branch point 514. The voltage VDD is input to the power supply line 417 from the terminal 304.

The power supply line 412 is connected to the power supply lines 414 and 415 at a branch point 512. The power supply line 416 is connected to the power supply lines 414 and 415 at a branch point 513.

The power supply line 413 supplies the voltage VDD which is supplied from the power supply line 411 or 417 to the control circuit 40. The power supply line 415 supplies the voltage VDD which is supplied from the power supply line 412 or 416 to the data line drive circuit 30. The power supply line 414 supplies the voltage VDD which is supplied from the power supply line 412 or 416 to the two scan line drive circuits 20.

In the configuration illustrated in FIG. 9, each of branch points 501 and 504 at which the common voltage of VHH and VEL branches into VHH and VEL is disposed on the outside of a region (range of a rectangle denoting display unit 10) where each element such as transistors, light emitting elements, capacitors, and the like which configure the display unit 10 are disposed, and a region (range of a rectangle denoting the scan line drive circuit 20) where each element such as transistors configuring the scan line drive circuit 20 is disposed. In addition, a plurality of the output circuits 25 included in the scan line drive circuit 20 can be disposed on the display unit 10 side. In this case, the output circuit 25 which uses the voltage VEL as an operation power supply and the pixel circuit 100 which is included in the display unit 10 can be disposed in a region surrounded by the power supply lines 405 and 406 shown in state of being shaded with diagonal line. In this case, the same voltage VEL can be used at a wide region as a substrate potential (back gate potential), and it is easy to prevent a voltage from changing.

In the third embodiment, the voltages VEL and VHH are input to the electro-optical device 1*b* as a common voltage, and each power supply line branches before entering a circuit block such as the display unit 10 and the scan line drive circuit 20 in the electro-optical device 1*b*. The power supply line 402 is separated from the power supply lines 405 and 406. In addition, a portion of the power supply line 402 which is located within the scan line drive circuit 20 is disposed to be separated from the power supply lines 403, 405, and 406. In the configuration illustrated in FIG. 9, the power supply lines 403 and 406, or the power supply lines 403, 405, and 406 correspond to the power supply line 51 illustrated in FIG. 1, and the power supply line 402 corresponds to the power supply line 53 illustrated in FIG. 1. In addition, the power supply line 405 (or an unillustrated power supply line branches from the power supply line 405 in a direction of the output circuit 25) corresponds to the power supply line 52 illustrated in FIG. 1. In addition, the branch point 502 corresponds to the branch point 61 illustrated in FIG. 1.

As described above, in the electro-optical device 1*b* according to the third embodiment, the power supply lines 403 and 406 (or the power supply lines 403, 405, and 406) (first power supply line) and the power supply line 402 (second power supply line) are connected to the power supply line 401 (fifth power supply line). In addition, the branch point 501 at which the power supply lines 403 and 406 (or power supply lines 403, 405, and 406) and the power supply line 402 branches from the power supply line 401 is disposed on the outside of a region where the respective elements configuring the display unit 10 are disposed and a region where the respective elements configuring the scan line drive circuit 20 are disposed. According to the aforementioned configuration of the third embodiment, there is an effect in which a configuration of a connection portion can be simplified, in addition to the effects of the first embodiment in which display unevenness is prevented from occurring without increasing the number of power supplies. That is, according to the third embodiment, the terminal for the voltage VEL and the terminal for the voltage VHH are commonly used, while, in the second embodiment, the connection terminal 731 for the voltage VEL and the connection terminal 732 for the voltage VHH are separately provided on the display circuit 71 side.

The electro-optical device 1 according to the present embodiment can be included in the following electronic apparatus. That is, the electro-optical device 1 according to the present embodiment can be employed in, for example, a display panel (see-through, closed) of a head-mounted display (HMD). In addition, the electro-optical device 1 according to the present embodiment may be included in an electronic apparatus which uses a display panel of a direct view type such as an electronic view finder (EVF) as an ultra-small display. In addition, a personal digital assistants (PDA), a digital still camera, a television, a video camera, a car navigation device, a pager, an electronic organizer, an electronic paper, a calculator, a word processor, a workstation, a videophone, a point of sale system (POS) terminal, a printer, a scanner, a copier, a video player, an apparatus having a touch panel, or the like can be used as an electronic apparatus according to the embodiment.

As such, the electro-optical device, an electronic apparatus, a drive method of the electro-optical device, and the like, according to the embodiment are described based on the aforementioned embodiments, but the invention is not limited the embodiments. For example, various forms can be realized in a range without departing from the gist, or the following modifications can also be made.

(1) In the present embodiment, the electro-optical device 1 is described by using the configuration illustrated in FIG. 1 as an example, but the invention is not limited to this.

(2) In the present embodiment, the configuration of the pixel circuit 100 is described by using the configuration illustrated in FIG. 3 as an example, but the invention is not limited to this.

(3) In the present embodiment, the transistors 101 to 105 configuring the pixel circuit 100 are described as P-channel MOS transistors, but the invention is not limited to this. The transistors 101 to 105 may be N-channel MOS transistors, and a gate of at least one transistor may be controlled by the same technical thought as in the present embodiment. In addition, the transistors 101 to 105 may be combinations of a P-channel MOS transistor and an N-channel transistor, and a gate of at least one transistor may be controlled by the same technical thought as in the present embodiment.

(4) In the present embodiment, the electro-optical element is described by using an OLED as an example, but the invention is not limited to this. For example, the embodiment can be applied to the electro-optical device which uses an inorganic light emitting diode, an LED, or the like as an electro-optical element.

(5) In the present embodiment, a configuration in which a demultiplexer supplies a data signal grouped for every three columns to each data line is described, but the invention is not limited to this. For example, the demultiplexer may supply a data signal grouped for every two columns to each data line, or may supply a data signal grouped for every four or more columns to each data line. Alternatively, the data line drive circuit 30 may have a configuration in which the demultiplexer is omitted.

(6) In the present embodiment, level shifting is performed by reducing a voltage range of the data signal using a capacitance dividing drive method, but the invention is not limited to this.

(7) In the aforementioned embodiments, the invention is described by using an electro-optical device, an electronic apparatus, a drive method of the electro-optical device, and the like, but the invention is not limited to this. For example, a program in which the sequence of processing of the drive method of the electro-optical device according to the embodiment is described, and a recording medium in which the program is recorded may be used.

The entire disclosure of Japanese Patent Application No. 2016-024833, filed Feb. 12, 2016 is expressly incorporated by reference herein.

What is claimed is:

1. An electro-optical device comprising:

a display unit that includes a plurality of pixel circuits which are arranged in a lattice shape in a row direction and a column direction;

a scan line drive circuit that scans the plurality of pixel circuits in the column direction by supplying a predetermined control signal including at least one scan signal to each of the pixel circuits which are arranged in the row direction among the plurality of pixel circuits;

a first power supply line that supplies a first operation voltage to at least one pixel circuit among the plurality of pixel circuits;

a second power supply line that supplies a second operation voltage to the scan line drive circuit, and is disposed separately from a portion of the first power supply line which is located within a region where the plurality of pixel circuits are arranged; and a third power supply line that is disposed separately from a portion of the second power supply line which is located within a region where the scan line drive circuit is disposed, wherein the scan line drive circuit includes a logic circuit that generates the control signal and an output circuit that outputs the control signal to at least one pixel circuit of the plurality of pixel circuits, and wherein the third power supply line supplies the first operation voltage to the output circuit from the first power supply line.

2. The electro-optical device according to claim 1, further comprising:

a display circuit that includes the display unit, the scan line drive circuit, the first power supply line, the second power supply line, and the third power supply line; and a substrate that is connected to the display circuit through a terminal portion and includes a fourth power supply line which is connected to the first power supply line and the second power supply line through a branch point around the terminal portion.

3. The electro-optical device according to claim 1, further comprising:

a fifth power supply line that is connected to each of the first power supply line and the second power supply line, wherein a branch point where the first power supply line and the second power supply line branch off from the fifth power supply line is disposed on an outside of a region where each element configuring the display unit is disposed and a region where each element configuring the scan line drive circuit is disposed.

* * * * *